US005829690A

United States Patent [19]

Deschamps

[11] Patent Number: 5,829,690

[45] Date of Patent: Nov. 3, 1998

[54] SHREDDING APPARATUS WITH SHEARING ACTION

[75] Inventor: Maurice Deschamps, Brantford, Canada

[73] Assignee: Sudrohrbau GmbH & Co., Germany

[21] Appl. No.: 619,497

[22] Filed: Jun. 7, 1996

[51] Int. Cl.[6] ..... B02C 18/16

[52] U.S. Cl. ..... 241/36; 241/37; 241/160; 241/243; 241/255.2; 241/DIG. 31

[58] Field of Search ..... 241/DIG. 31, 243, 241/285.2, 36, 37, 160

[56] References Cited

U.S. PATENT DOCUMENTS

| | | | |
|---|---|---|---|
| 194,776 | 9/1877 | Hull | 241/243 X |
| 2,959,362 | 11/1960 | Smith et al. . | |
| 3,703,970 | 11/1972 | Benson | 241/243 X |
| 4,015,782 | 4/1977 | Granite | 241/243 X |
| 4,142,688 | 3/1979 | Johnson et al. | 241/243 X |
| 4,394,983 | 7/1983 | Ulsky . | |
| 4,678,126 | 7/1987 | Prentice et al. | 241/243 X |
| 5,333,802 | 8/1994 | Seelig et al. | 241/243 X |

FOREIGN PATENT DOCUMENTS 0006261 1/1980 European Pat. Off. .

WO91/17690 11/1991 WIPO .

*Primary Examiner*—Mark Rosenbaum
*Attorney, Agent, or Firm*—R. Craig Armstrong

[57] ABSTRACT

A shredding apparatus includes a rotor having rows of tines projecting generally radially outwardly therefrom, and also a housing surrounding the rotor having rows of tines projecting generally radially inwardly therefrom. The rotor tines and stator tines have staggered positions, with one or more of the rotor tines passing between adjacent stator tines. Material inserted into an inlet at the top of the housing is caught by the rotor tines and pulled past the first row of stator tines. That first row has fewer tines than does each row of tines on the rotor, whereas the final row has the same number of tines as each row on the rotor. The opposing faces of the tines on the rotor and stator are flat, with a small clearance between passing tines, of typically about ⅛ of an inch. The passing flat faces on the tines are at a slight angle to each other, the outer ends of rotor tines passing stator tines ahead of the inner ends in a scissors-like fashion. The rotor speed is a function of the material being shredded, and has a value of at least 500 rotations per minute. A multi-stage shredding assembly may be created in which the output from one shredding apparatus feeds another shredding apparatus.

11 Claims, 7 Drawing Sheets

SHREDDING APPARATUS WITH SHEARING ACTION

TECHNICAL FIELD

This invention relates to an apparatus for shredding materials, in recycling operations for example, and more particularly to a shredding apparatus in which rows of rotor tines pass through rows of stator tines to shear the materials.

BACKGROUND ART

There is an increasing awareness of the need to preserve the quality of the global ecosystem through recycling of discarded materials. An initial step in such recycling involves reducing such materials to a basic form in which they can be more easily handled, usually through a process such as melting or shredding.

Used tires, for example, are presently increasingly being recycled, and the shredding of such tires into tiny fragments is a first step in such recycling. The storage of used tires in piles presents both a fire hazard and a health hazard. Burning of used tires releases into the atmosphere various substances mixed into the constituent rubber during its production and vulcanization, including compounds such as tars, silica, paraffin, aromatic amines or phenol derivatives, asbestos, accelerator compounds, etc., which are known or hypothesized to have mutagenic and carcinogenic properties. In some jurisdictions, laws have been enacted or proposed requiring the safe destruction of used tires to avoid such environmental and health hazards.

Besides removing their potential for creating environmental and health problems, shredding of used tires obviates the need for new expenditures on energy and long-chain hydrocarbon resources, such as natural and synthetic rubbers. The extraordinary elastic properties and resistance to wear of vulcanized rubber due to the cross-linking of rubber molecules by "sulphur bridges" has caused vulcanized rubber to be used as a raw material for a vast range of products. There is consequently a large market for vulcanized rubber fragments generated by shredding of used tires.

Research into possible new applications for shredded tires is proceeding at a rapid pace, and many new applications have been developed recently.

Although the foregoing comments have related to the recycling of rubber in used tires, the shredding process of course has broad application in the effective handling of a wide range of other materials. For instance, shredding is used as a first step in the recycling of waste plastic. And the recovery of oil, metal, paper and rubber from used oil filters is on the verge of becoming a major industry. In a more general application of the shredding process, garbage volume in a landfill site may be reduced by first putting the garbage through a shredding process.

Various forms of shredding apparatus are of course well-known in the prior art. Many designs are known and in use at present, but generally they suffer from a number of drawbacks, including excessive complexity, unreliability, high price, and/or lack of transportability.

Prior art shredding devices are generally designed to shred material fed between cutters by tearing the material apart. Significant expenditures of energy are required to drive such machines.

A possible exception is the apparatus described in international application no. PCT/US91/03451, published 28 Nov. 1991 under publication no. WO 91/17690, which is designed to shred vehicle tires by drawing them through a shredder in which cutting teeth and U-shaped cutting edges coact to shred the tire. The present invention is configured quite differently from that apparatus, however.

DISCLOSURE OF INVENTION

It is an object of the invention to provide a shredding apparatus that is reliable, relatively simple in construction, and relatively lightweight.

It is a further object of the invention to provide a shredding apparatus that is effective in reducing a product to pieces of roughly uniform size for any given product, using as little energy as possible.

It is also desirable that the apparatus should be fully enclosed and transportable.

In the prior art, many shredding devices utilize a tearing action, which expends a great deal of energy. In the shredding apparatus of the present invention, shearing is the primary shredding mechanism, which reduces the energy expenditure. The subject apparatus also reduces materials to pieces of roughly uniform size, thereby simplifying and making more economical further processing of those pieces, which in turn increases their utility. Another desirable attribute of the subject apparatus is its relatively light weight in comparison to other shredding devices, and hence its increased portability relative to most prior art shredding devices. The fact that the apparatus is preferably fully enclosed in an external housing further facilitates transportation.

In one form, the invention is a shredding apparatus comprising a rotor mounted to rotate between a pair of side walls, a housing extending in an arc on one side of the rotor between the pair of side walls, an inlet means for feeding material into an entry opening between the rotor and the housing, and a motor for rotating the rotor relative to the housing. The rotor has tines projecting generally radially outwardly therefrom in a series of rows equiangularly positioned around it. Each of those rows extends generally parallel to the axis of rotation. Each rotor tine has a generally flat face in the direction of rotation, those flat faces on tines in the same row extending generally in the same plane. The housing has stator tines projecting generally radially inwardly therefrom in a series of rows extending generally parallel to the axis of rotation. The stator tines are positioned such that one or more of the rotor tines pass between adjacent stator tines. Each stator tine has a generally flat face in the direction adapted to oppose the flat face on passing rotor tines. The flat faces on stator tines in the same row extend generally in the same plane. Each of the rotor tines and stator tines have a length substantially equal to the radial distance between facing surfaces on the rotor and the housing. Each of the rotor tines and stator tines is of substantially equal width, and the clearance between passing rotor and stator tines is quite small, such as approximately 3 mm (⅛ of an inch) for most applications. The clearance could be smaller in some cases, or larger in others, especially larger machines. The motor rotates the rotor relative to the housing at a speed of at least 500 rotations per minute. The rotor tines and stator tines are oriented such that the flat faces on one or both are angled slightly away from the radial direction such that the outer ends of the rotor tines pass the stator tines before the inner ends of the rotor tines. A small angle is thereby defined between the flat faces on the rotor tines and the flat faces on the stator tines as those tines pass.

The small angle is preferably in the range of 5 to 20 degrees. The rotor tines and stator tines may be approximately 25 mm (1 inch) wide, and pass each other at a clearance of approximately 3 mm (⅛ of an inch). The flat faces on the rotor tines and stator tines may be replaceably mounted on the rotor and housing, respectively.

There may be three rows of rotor tines spaced 120 degrees apart, and three rows of stator tines. In this arrangement, the rotor tines pass the first row of stator tines before passing the second row of stator tines before passing the third row of stator tines. The tines in the first and second rows of stator tines are arranged longitudinally on the housing in pairs that are spaced from each other by the spacing of a missing pair. Each pair of stator tines in the first and second rows correspond in longitudinal position to a missing pair in the second and first rows respectively. The third row of stator tines and the three rows of rotor tines each have tines with longitudinal positions corresponding to the tines in both the first and second rows of stator tines.

The housing preferably is movable relative to the rotor to increase the distance between facing surfaces on the rotor and the housing for facilitating maintenance and cleaning of the apparatus, and particularly for facilitating clearance of any jams.

In a further form, the invention is a shredder assembly that comprises a first shredding apparatus and a second substantially-smaller shredding apparatus. The inlet means of the second shredding apparatus is adapted to receive material output from the first shredding apparatus.

BRIEF DESCRIPTION OF DRAWINGS

The invention will next be more fully described by means of a preferred embodiment, utilizing the accompanying drawings, in which.

BEST MODE FOR CARRYING OUT THE INVENTION

Figure 1:
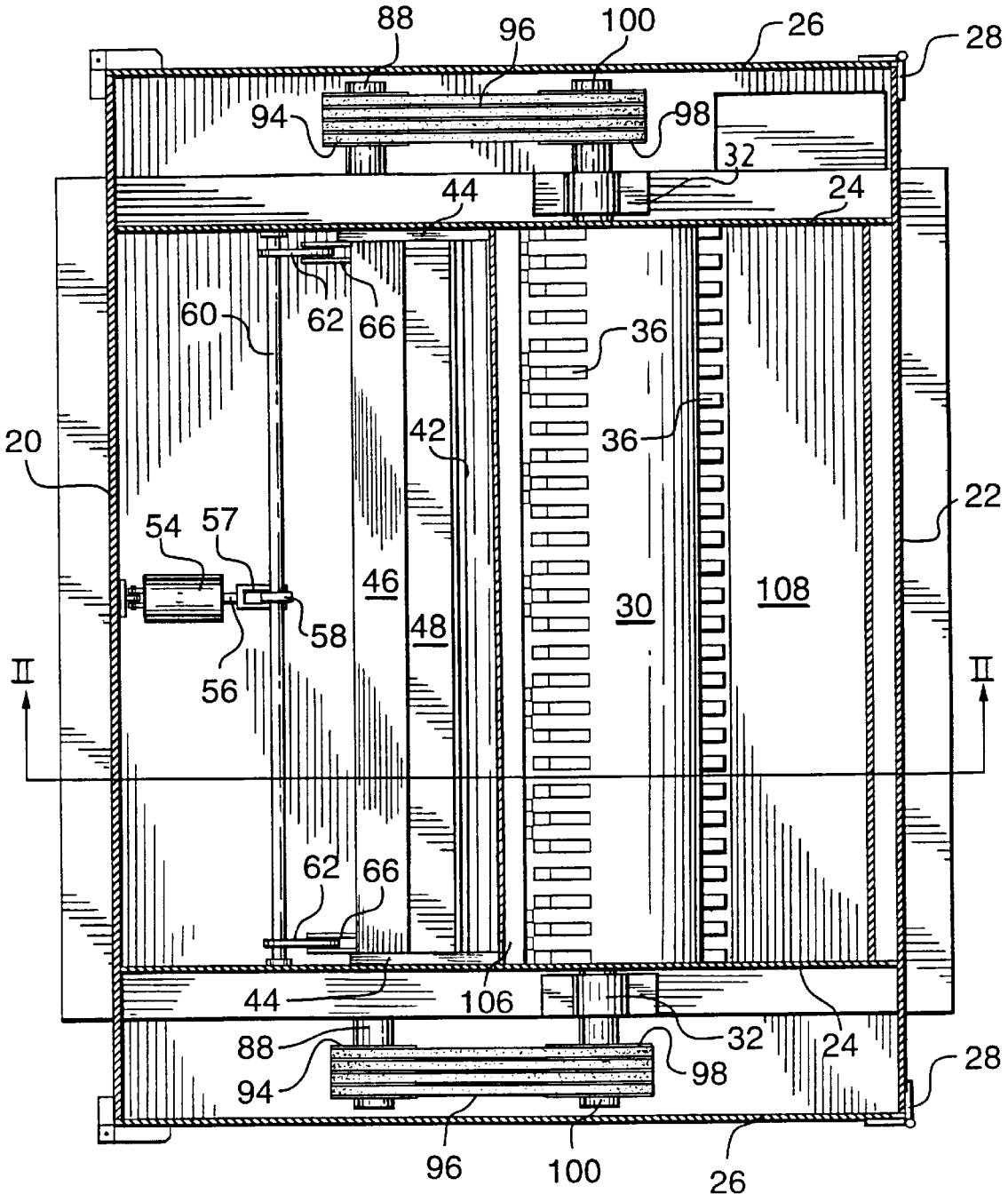
FIG. 1 is a sectioned plan view of the shredding apparatus of the invention, the view being taken along the line I—I in FIG. 2.

As shown in the plan view of FIG. 1, the preferred embodiment of the shredding apparatus has a front wall 20, a back wall 22, a pair of inner side walls 24, and a pair of outer side walls 26. Each of the outer side walls 26 is mounted on a set of hinges 28.

A rotor generally designated 30 is mounted on a pair of bearings 32, each of which is supported on a respective section of square tubing 34 secured to one of the inner side walls 24. Three rows of rotor tines 36 each extend across rotor 30, each of the three rows being angularly displaced 120 degrees from the other two rows. Each rotor tine 36 has a flat front face in the direction of rotation of rotor 30, a flat top face, and a flat sloping back face. The spacing between adjacent rotor tines 36 is slightly greater than the width of a tine 36.

Figure 2:
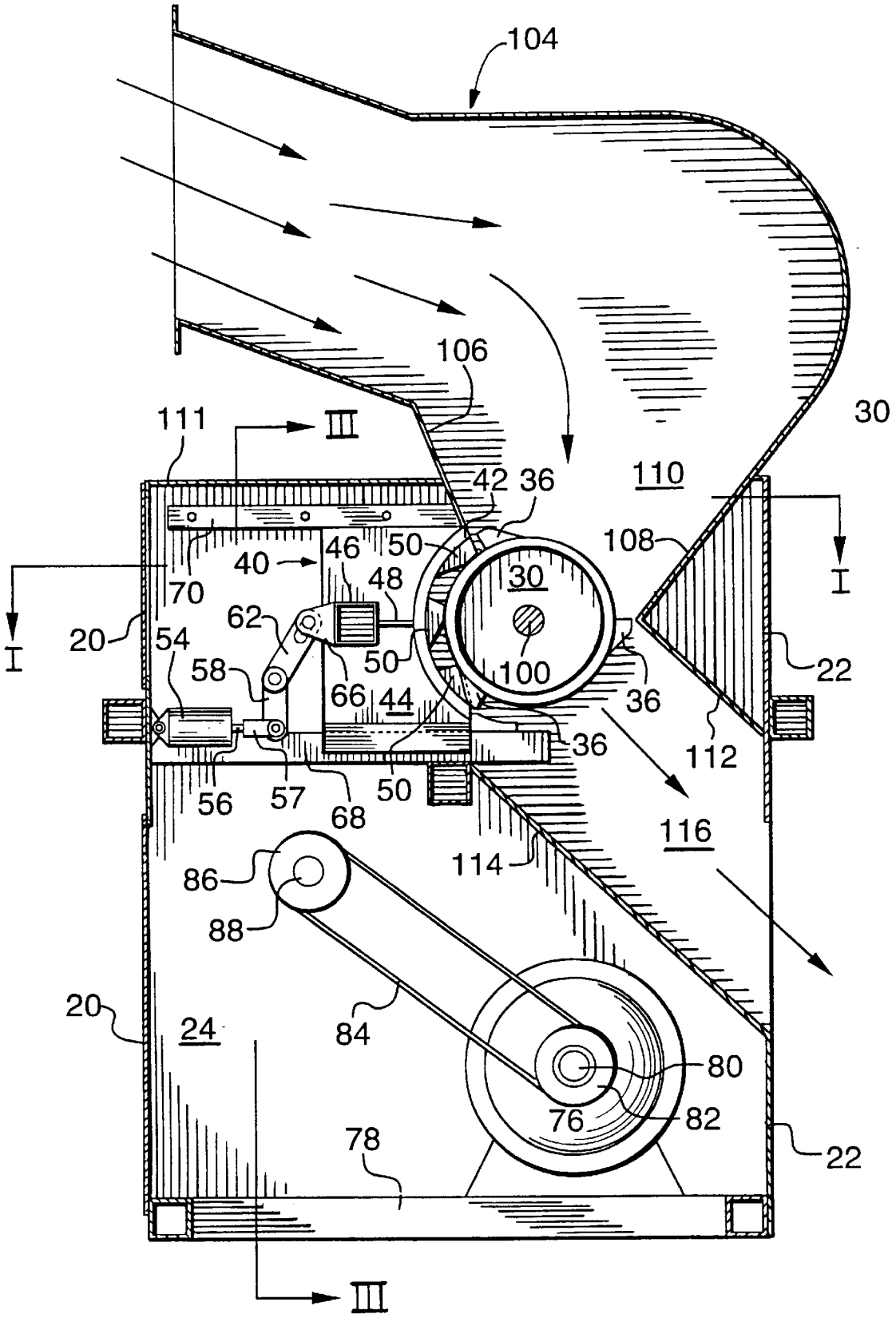
FIG. 2 is a sectioned side view of the shredding apparatus, the view being taken along the line II—II in FIG. 1.
Figure 5:
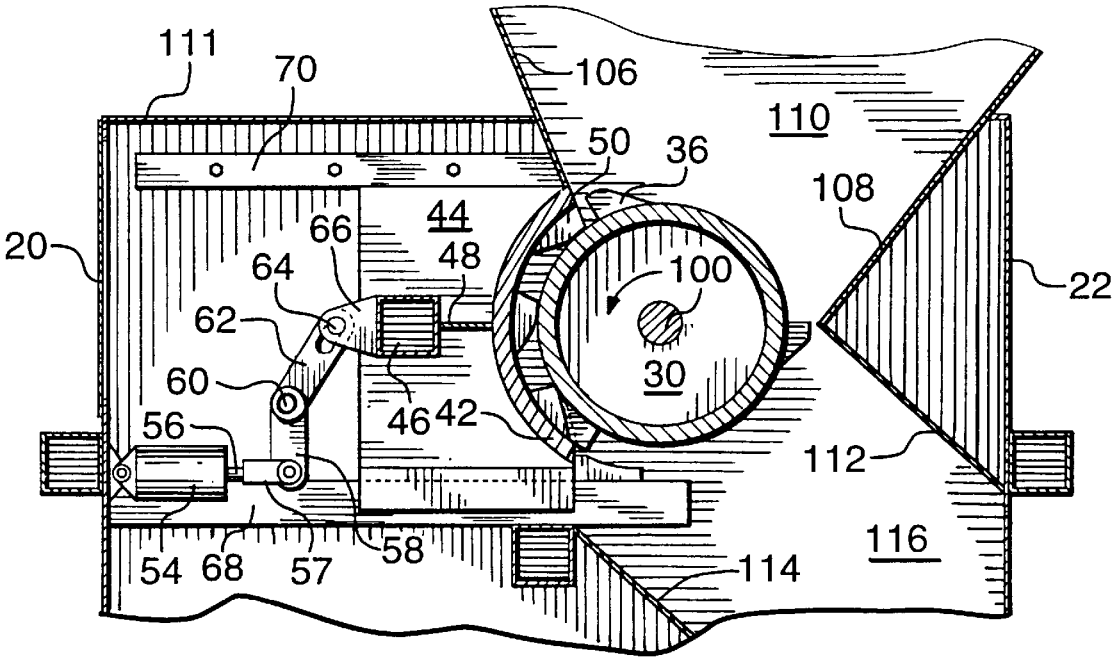
FIG. 5 is a portion of the sectioned side view of FIG. 2, the housing member of the shredding apparatus being in position for the shredding operation.
Figure 7:
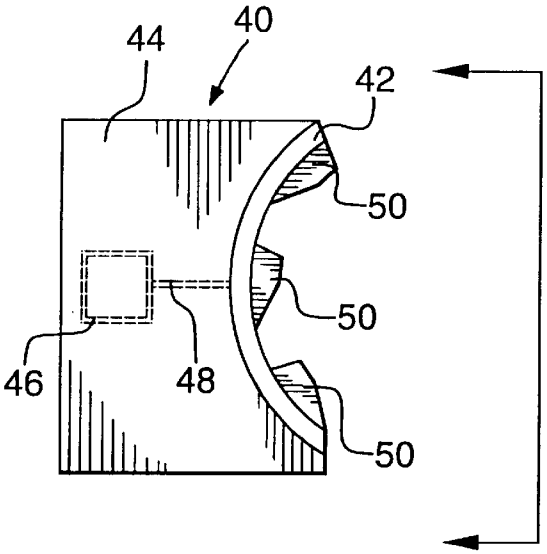
FIG. 7 is a side view of the housing member of the shredding apparatus.
Figure 8:
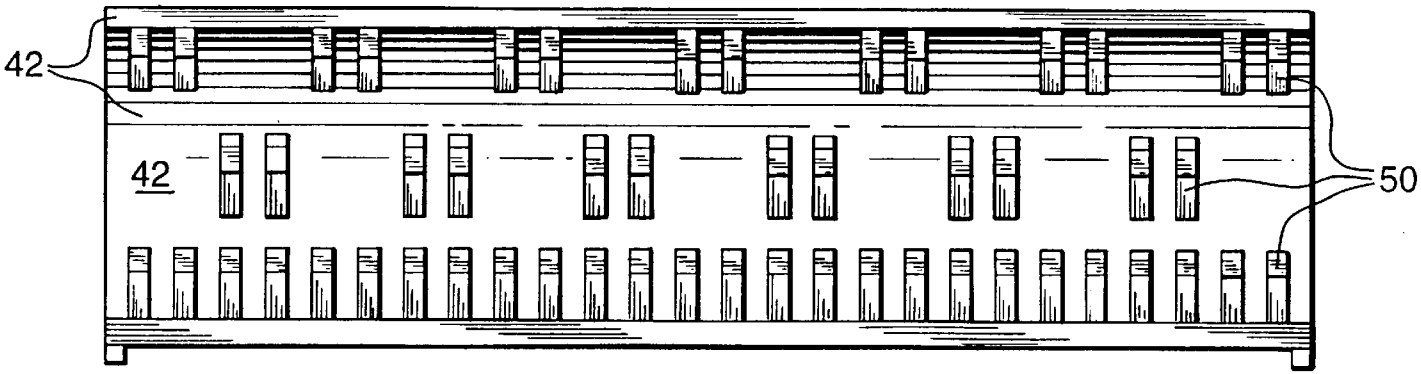
FIG. 8 is an end view of the housing member of FIG. 7, the view illustrating the position of the three rows of tines on the housing member.
Figure 9:
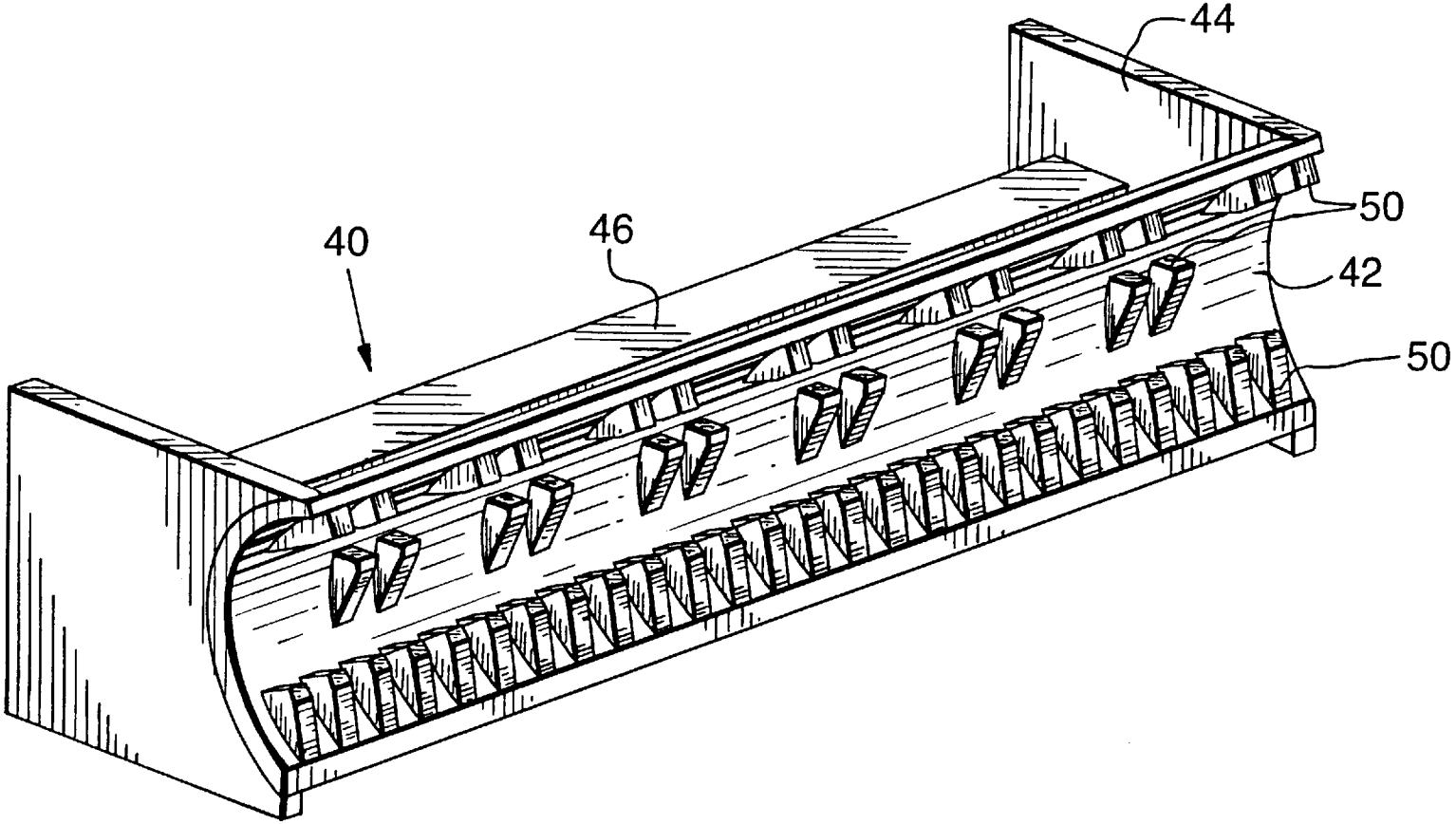
FIG. 9 is a perspective view of the housing member of FIG. 7.

A housing generally designated 40 and separately illustrated in FIG. 7 has an arc member 42, each end of which is connected to a side member 44. A square tubing section 46 extends between the side members 44, and a plate 48 connects side members 44, tubing section 46 and arc member 42. In its operative position, as illustrated in FIGS. 2 and 5, arc member 42 extends concentrically around the axis of rotation of rotor 30. Three rows of stator tines 50 each extend across arc member 42, as illustrated in FIGS. 8 and 9. Tines 50 in the first and second rows are arranged longitudinally on the inner surface of arc member 42 in pairs that are spaced from each other by the spacing of a missing pair. Each pair of tines 50 in the first and second rows correspond in longitudinal position on arc member 42 with a missing pair of tines 50 in the second and first rows, respectively. The tines 50 in the third row on arc member 42 are longitudinally positioned so as to correspond with the tines 50 in both the first and second rows. The longitudinal position of the stator tines 50 on arc member 42 are staggered from the longitudinal position of the rotor tines 36 on rotor 30, allowing the rotor tines to pass the stator tines with a slight clearance. The stator tines have a similar shape to the shape previously described for rotor tines. The height of the rotor and stator tines is such that when housing 40 is in its operative position, the end of the rotor tines have a slight clearance from the inner surface of arc member 42, and the end of the stator tines have a slight clearance from the surface of rotor 30, a typical clearance in each case being about 3 mm (⅛ of an inch).

Material entering the shredding apparatus is pressed by the rotor tines 36 against the first and second rows of stator tines 50 having the tine spacing earlier described. The material is shredded into fragments of a small size by those two rows. The resulting fragments are then pressed against the third row of stator tines 50; the number of tines in that third row equals the number of tines in each row of rotor 30. The material is shredded by the third row of stator tines into fragments of still smaller size.

As illustrated in FIG. 2, the flat front face on each rotor tine 36 is set at a slight angle relative to the flat opposing face on each stator tine 50. The outer end of each tine 36 thereby passes the opposing face on a tine 50 before the inner end of tine 36 passes that face, and a scissors-like shearing action results.

The width of a rotor tine 36 is approximately the same as the width of a stator tine 50, and the clearance between those sets of tines as they pass is quite small in relation to the tine width. With a tine width of 25 mm (1 inch), the clearance is approximately 3 mm (⅛ of an inch) in the preferred embodiment, although other small clearances could obviously be used, the acceptable range depending somewhat on the materials being shredded, keeping in mind that shearing is the desired mechanism. There is a small angle of preferably between 5 and 20 degrees formed between the flat front face of each rotor tine 36 and the flat opposing face of each stator tine 50, with the outer end of a rotor tine 36 therefore passing the leading edge of a stator tine 50 ahead of the inner end of the rotor tine 36. A scissors-like shearing action thereby commences as a rotor tine passes a stator tine, the action starting at the outer end of the rotor tine and progressing inwardly.

Figure 4:
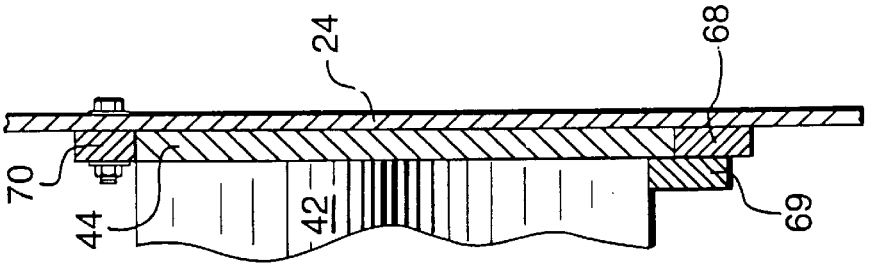
FIG. 4 is an amplified view of a portion of FIG. 3 illustrating the mounting of an end of the housing member on the side wall of the apparatus.
Figure 3:
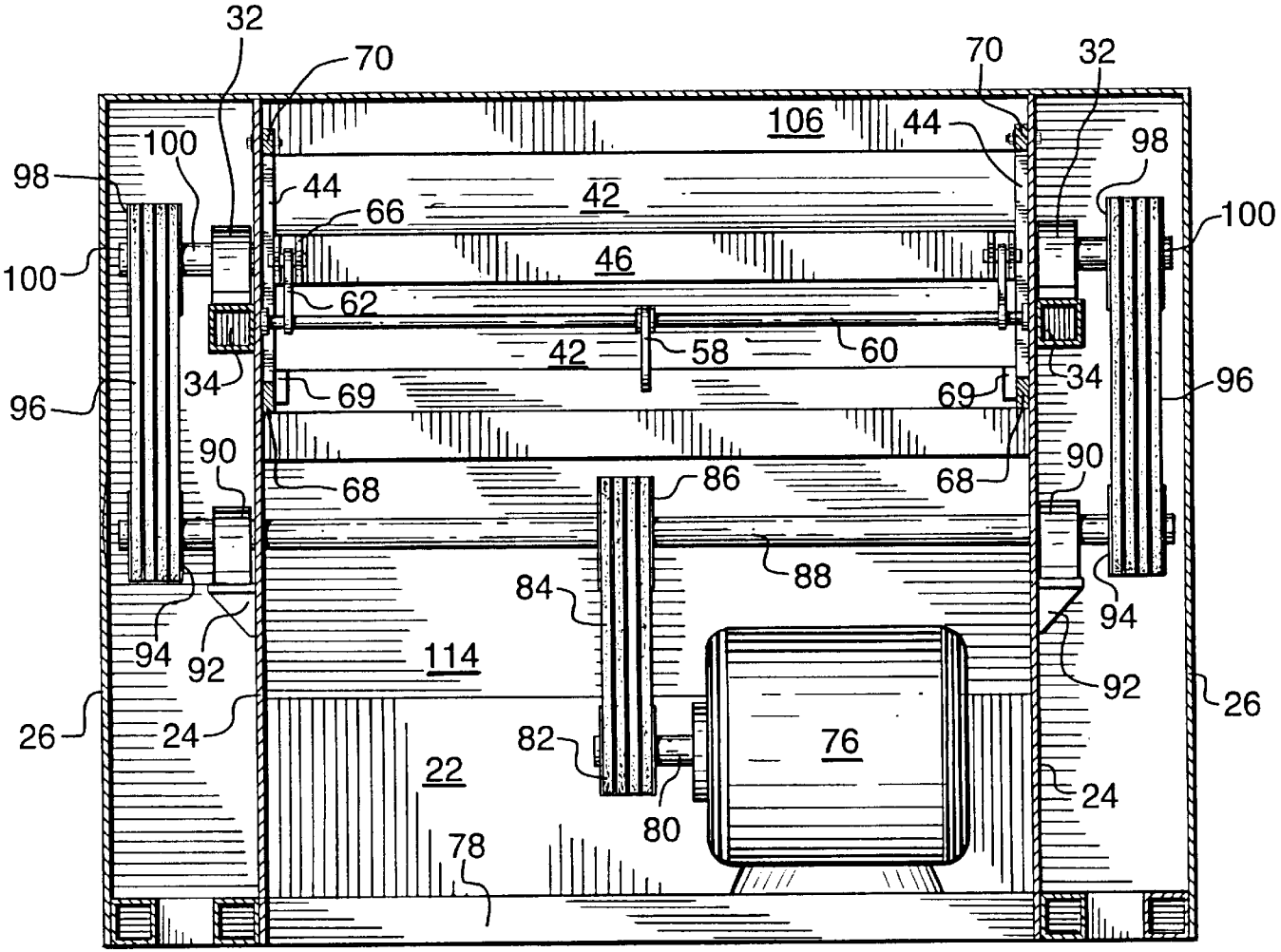
FIG. 3 is a sectioned end view of the shredding apparatus, the view being taken along the line III—III in FIG. 2.
Figure 6:
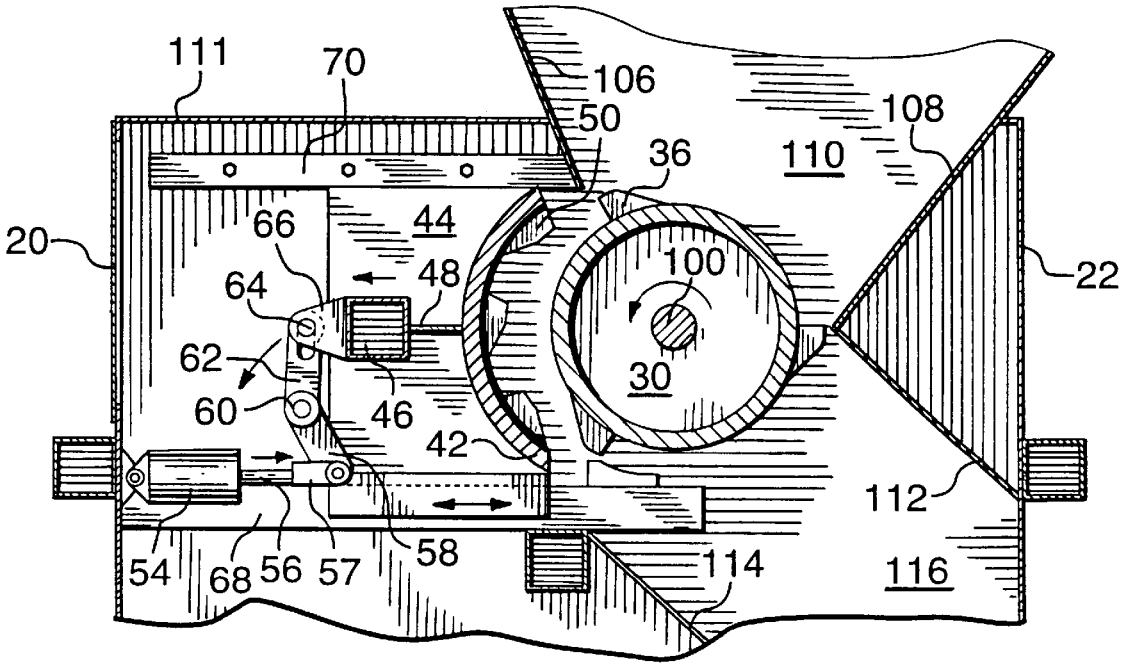
FIG. 6 is a similar view to FIG. 5, but illustrating the housing member in a retracted position.

Housing 40 can be shifted from the operative position shown in FIGS. 2 and 5 to a retracted position allowing cleaning or maintenance, shown in FIG. 6, and especially facilitating the clearance of jams. This is accomplished by means of a hydraulic cylinder 54 that drives a piston 56 which is pivotally connected by a collar 57 to one end of an arm 58. The other end of arm 58 is fixed to a central position on a bar 60. Each end of bar 60 is rotatably mounted on a respective one of the inner side walls 24. One end of a pair of arms 62 is fixed to a respective one of the ends of bar 60. The other end of each arm 62 is slotted to receive a pin 64 that extends between a pair of brackets 66 connected to rectangular tubing section 46. As illustrated in FIG. 3 and the amplified view in FIG. 4, each side member 44 of housing 40 slides in a recess defined by a lower bracket 68, a lateral guide member 69 secured to lower bracket 68, and an upper bracket 70. Movement of piston 56 out of cylinder 54 results in housing 40 moving from its operative position to the retracted position.

The sequence of operation on startup, or after a stoppage due to a jam, is that hydraulic fluid is pumped to hydraulic cylinder 54 by an electric motor (not shown) that is activated automatically each time electric motor 76 is switched on, so that the housing 40 moves from its operative position. The rotor 30 then starts to turn, which clears away any jammed material or any material left in the apparatus from a previous shutdown. The housing is then returned to its operative position, at which time shredding operations may be recommenced.

An electrical motor 76 of approximately 110 kW (150 horsepower) is fastened to the base 78 of the shredding apparatus. The rotor 80 of motor 76 has a four-belt pulley 82 mounted on it. Four belts 84 extend around both that pulley and a four-belt pulley 86 on a driven shaft 88. Shaft 88 is mounted in a pair of bearings 90 that are each supported on an inner side wall 24 by a bracket 92. Each end of shaft 88 has a four-belt pulley 94 mounted on it, and four belts 96 extends around both that pulley and a four-belt pulley 98 mounted on the axle 100 of rotor 30. These features are best illustrated in FIG. 3. By choosing appropriately-sized pulleys 82 and 86, the motor 76 is capable of rotating rotor 30 at typical speeds of from 500 r.p.m. to over 3,000 r.p.m.; the optimum rotational speed is a function of the material being shredded, and is best determined through routine experimentation.

The material to be shredded is fed to the shredding apparatus through a broad feed channel generally designated 104, illustrated in profile in FIG. 2. A portion of feed channel 104 is an input chute, defined by opposing inclined surfaces 106 and 108 and by opposing parallel surfaces 110, and mounted in a top wall 111 of the apparatus. An output chute is defined by opposing inclined surfaces 112 and 114 and by opposing parallel surfaces 116.

By connecting the output chute of the shredding apparatus to the input chute of another shredding apparatus, it is possible to build a two-stage or three-stage assembly. The rotors and tines in a second and/or third stage are smaller than in the first stage, and the rotors are driven at correspondingly greater angular speed. Tires are an example of a material that generally requires more than a single-stage shredding apparatus for complete reduction.

Figure 10:
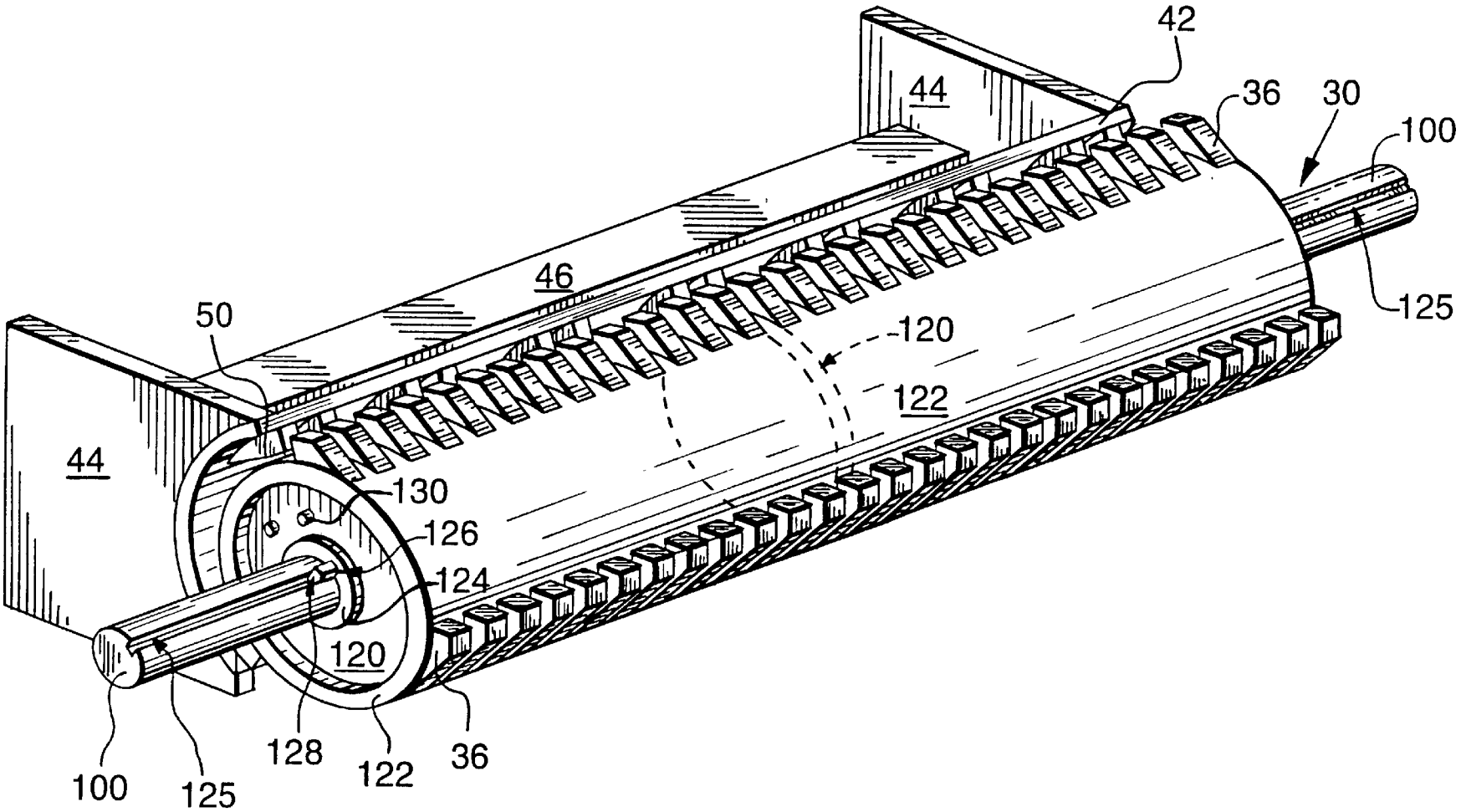
FIG. 10 is a perspective view of the housing member of FIG. 7, and also illustrating the rotor of the apparatus in its operative position.

As illustrated in FIG. 10, rotor 30 has a steel axle 100 of 6.35 cm (2.5-inch) diameter, three steel disks 120 of 25 mm (1-inch) thickness and 30.5 cm (12-inch) diameter, and a circular cylindrical steel tube 122 of 25 mm (1-inch) thickness and 30.5 cm (12-inch) inside diameter. Each of the disks 120 is welded circumferentially to steel tube 122, one disk proximate each end and one centrally. A disk 124 of 15 cm (6-inch) diameter is circumferentially welded to the outside of each of the end-positioned disks 120 to extend concentric with the respective disk. Each end of axle 100 has a spline 125 that is 15 cm (6 inches) long and approximately 1.27 cm (0.5 inches) square. A spline 126 of similar cross-section extends in each of the end-positioned disks 120 and 124, and a key 128 is fitted between splines 125 and 126 to prevent relative rotation between axle 100 and disks 120 and 124. After rotor 30 is constructed with its complement of tines 36, it is balanced. To balance rotor 30, holes of 2.5 cm (1-inch) diameter are drilled at appropriate angular locations in each disk 120, and a steel dowel 130 of 2.5 cm (1-inch) diameter is mounted in each hole. The length of each dowel 130 is selected so as to provide the required balance to the disk 120.

The tines 36, which are made of hardened steel, may be constructed with a replaceable flat front face portion that is fastened to the remainder of the tine to allow periodic replacement. The following table illustrates, for a series of materials, the width and radial height of the tines used and the angular speed of the rotor:

TABLE 1

| Material | Tine Height cm (inches) | Tine Width cm (inches) | Angular Speed (r.p.m.) |
|---|---|---|---|
| Glass* | 2.5 (1) | 2.5 (1) | 3,000 |
| Tires | 10 (4) | 2.5–7.5 (1–3) | 500 |
| Carpet | 1.25 (0.5) | 1.25 (0.5) | 1,800–2,000 |
| Wood pallets | 3.8 (1.5) | 2.5 (1) | 500–1,800 |
| Wood stumps | 10 (4) | 2.5 (1) | 500–1,800 |
| Plastic* | 2.5 (1) | 2.5 (1) | 2,800 |
| Paint cans* | 3.8 (1.5) | 2.5 (1) | 2,800 |
| Batteries | 3.8 (1.5) | 2.5 (1) | 2,800 |
| Oil Filters | 5 (2) | 2.5 (1) | 1,000–1,500 |
| Gypsum | 3.8–5 (1.5–2) | 2.5 (1) | 1,800 |

The first and second stator rows of an apparatus for shredding the materials marked with an '*' differ from the construction earlier described in that each of the first and second stator rows have as many tines as the third row.

Some materials may require a multi-stage shredding process. For instance, used tires require at least a two-stage assembly, with the rotor in the first stage rotating at 500 r.p.m, and at the same or faster r.p.m. in subsequent stages. The rotor tines and stator tines used to shred tires have a height of 10 cm (4 inches) and a width of anywhere from 2.5 to 7.5 cm (1 to 3 inches). The tine height and width, and the angular speed of rotor 30, are best determined through trial-and-error for each application. Besides the above-mentioned materials, the shredding apparatus has been used to shred such diverse articles as empty beer bottles in their cardboard cases, transformers, emptied mercury light bulbs and bed boards. These objects come out of the shredding apparatus as tiny fragments of the constituent materials; those shredded materials are then readily separable from each other by further processing.

INDUSTRIAL APPLICABILITY

The shredding apparatus of the invention utilizes a shearing action to shred materials efficiently.

I claim:

1. A shredding apparatus, comprising:

(a) a rotor (30) mounted to rotate between a pair of side walls (24), the rotor having tines (36) projecting generally radially outwardly therefrom, the rotor tines extending in a series of rows equiangularly-positioned around the rotor, each of the rows extending generally parallel to the axis of rotation, each rotor tine having a generally flat face in the direction of rotation, those flat faces on tines in the same row extending generally in the same plane;

(b) a housing (40) extending in an arc on one side of the rotor between the pair of side walls, the housing having stator tines (50) projecting generally radially inwardly therefrom in a series of rows extending generally parallel to the axis of rotation, the stator tines being positioned such that one or more of the rotor tines pass between adjacent stator tines, each stator tine having a generally flat face in the direction adapted to oppose the flat face on passing rotor tines, the flat faces on stator tines in the same row extending generally in the same plane, each of the rotor tines and stator tines having a height slightly smaller than the radial distance between facing surfaces on the rotor and the housing, each of the rotor tines and stator tines being of substantially equal width, the clearance between passing rotor tines and stator tines being small in relation to the width of the tines, so as to produce shearing action;

(c) an inlet means (104) for feeding material into an upper entry opening between the rotor and the housing; and, (d) a motor (76) for rotating the rotor relative to the housing at a speed of at least 500 rotations per minute;

wherein the rotor tines and the stator tines are oriented such that the flat faces on one or both are angled slightly away from the radial direction such that the outer ends of the rotor tines pass the stator tines before the inner ends of the rotor tines, a small angle being defined between the flat faces on the rotor tines and the flat faces on the stator tines as those tines pass.

2. A shredding apparatus as in claim 1, wherein the small angle is in the range of 5 to 20 degrees.

3. A shredding apparatus as in claim 1, wherein the rotor tines and stator tines are each approximately 25 mm (1 inch) wide, and pass each other at a clearance of approximately 3 mm (⅛ of an inch).

4. A shredding apparatus as in claim 1, wherein the flat faces on the rotor tines and stator tines are replaceably mounted on the rotor and housing, respectively.

5. A shredding apparatus as in claim 1, wherein there are three rows of rotor tines spaced 120 degrees apart, and three rows of stator tines.

6. A shredding apparatus as in claim 1, wherein there are three rows of rotor tines spaced 120 degrees apart, and three rows of stator tines, the rotor tines passing the first row of stator tines before passing the second row of stator tines before passing the third row of stator tines, the tines in the first and second rows of stator tines being arranged longitudinally on the housing in pairs that are spaced from each other by the spacing of a missing pair, each pair of stator tines in the first and second rows corresponding in longitudinal position to a missing pair in the second and first rows respectively, the third row of stator tines and the three rows of rotor tines each having tines with longitudinal positions corresponding to the tines in both the first and second rows of stator tines.

7. A shredding apparatus as in claim 1, wherein the housing is retractable from its operative position, to increase the distance between facing surfaces on the rotor and the housing.

8. A shredding apparatus as in claim 7, including control means by which a startup or jam clearance sequence may be initiated, said sequence comprising the steps of first retracting said housing from its operative position, then commencing or recommencing rotation of the rotor, thereby clearing away any remaining material, and then returning the housing to its operative position so that normal shredding operations may be recommenced.

9. A shredder assembly, comprising a first and second shredding apparatus, each said shredding apparatus comprising:

(a) a rotor mounted to rotate between a pair of side walls, the rotor having tines projecting generally radially outwardly therefrom, the rotor tines extending in a series of rows equiangularly-positioned around the rotor, each of the rows extending generally parallel to the axis of rotation, each rotor tine having a generally flat face in the direction of rotation, those flat faces on tines in the same row extending generally in the same plane;

(b) a housing extending in an arc on one side of the rotor between the pair of side walls, the housing having stator tines projecting generally radially inwardly therefrom in a series of rows extending generally parallel to the axis of rotation, the stator tines being positioned such that one or more of the rotor tines pass between adjacent stator tines, each stator tine having a generally flat face in the direction adapted to oppose the flat face on passing rotor tines, the flat faces on stator tines in the same row extending generally in the same plane, each of the rotor tines and stator tines having a length substantially equal to the radial distance between facing surfaces on the rotor and the housing, each of the rotor tines and stator tines being of substantially equal width, the clearance between small in relation to the width of the tines, so as to produce shearing action;

(c) an inlet means for feeding material into an upper entry opening between the rotor and the housing; and, (d) a motor for rotating the rotor relative to the housing at a speed of at least 500 rotations per minute;

wherein the rotor tines and the stator tines are oriented such that the flat faces on one or both are angled slightly away from the radial direction such that the outer ends of the rotor tines pass the stator tines before the inner ends of the rotor tines, a small angle being defined between the flat faces on the rotor tines and the flat faces on the stator tines as those tines pass;

the inlet means of the second shredding apparatus being positioned to receive material output from the first shredding apparatus.

10. A shredding apparatus, comprising:

(a) a rotor (30) mounted to rotate between a pair of side walls (24), the rotor having tines (36) projecting generally radially outwardly therefrom, the rotor tines extending in a series of rows equiangularly positioned around the rotor, each of the rows extending generally parallel to the axis of rotation;

(b) a housing (40) extending on one side of the rotor between the pair of side walls, the housing having stator tines (50) projecting generally radially inwardly therefrom in at least two rows extending generally parallel to the axis of rotation, the stator tines being positioned such that one or more of the rotor tines pass between adjacent stator tines, each stator tine having a generally flat face in the direction adapted to oppose the flat face on passing rotor tines, the flat faces on stator tines in the row extending generally in the same plane, each of the rotor tines and stator tines being of substantially equal width, the clearance between passing rotor tines and stator tines being small in relation to the width of the tines, so as to produce shearing action; and (c) an inlet means (104) for feeding material into an upper entry opening between the rotor and the housing;

wherein said rotor tines have a generally flat face in the direction of rotation and are adapted to oppose the flat faces on passing stator tines, said stator tines project in series of at least two rows, said flat faces on stator tines in the same row extend generally in the same plane, and the rotor with said rotor tines is rotating relatively to the stator tines at a speed of at least 500 rotations per minute.

11. A shredding apparatus according to claim 10, wherein the housing (40) with said projecting stator tines extends in an arc between said pair of walls (24), and each of said rotor tines (36) and said stator tines (50) has a height substantially equal to the radial distance between facing surfaces on the rotor and the stator.

* * * * *